US010864400B2

(12) United States Patent
Schween

(10) Patent No.: US 10,864,400 B2
(45) Date of Patent: Dec. 15, 2020

(54) EXERCISE APPARATUS WITH MOVABLE VERTICAL MEMBERS

(71) Applicant: Kraftig Industries Pty Ltd, Sinnamon Park (AU)

(72) Inventor: Michael Schween, Sinnamon Park (AU)

(73) Assignee: Kraftig Industries Pty Ltd, Sinnamon Park (AU)

( * ) Notice: Subject to any disclaimer, the term of this patent is extended or adjusted under 35 U.S.C. 154(b) by 0 days.

(21) Appl. No.: 15/739,388

(22) PCT Filed: Jun. 23, 2016

(86) PCT No.: PCT/AU2016/050532
§ 371 (c)(1),
(2) Date: Dec. 22, 2017

(87) PCT Pub. No.: WO2016/205883
PCT Pub. Date: Dec. 29, 2016

(65) Prior Publication Data

US 2019/0134452 A1 May 9, 2019

(30) Foreign Application Priority Data

Jun. 23, 2015 (AU) ..... 2015902424
Oct. 19, 2015 (AU) ..... 2015904285
Oct. 19, 2015 (AU) ..... 2015904286

(51) Int. Cl.
*A63B 22/00* (2006.01)
*A63B 21/068* (2006.01)
(Continued)

(52) U.S. Cl.
CPC ..... *A63B 21/0626* (2015.10); *A63B 1/00* (2013.01); *A63B 21/0056* (2013.01);
(Continued)

(58) Field of Classification Search
CPC ..... A63B 21/062–0632; A63B 21/078; A63B 22/0046; A63B 21/0626; A63B 21/0628;
(Continued)

(56) References Cited

U.S. PATENT DOCUMENTS 399,632 A 3/1889 Reach
2,666,640 A 1/1954 Jennings, Sr.
(Continued)

OTHER PUBLICATIONS

Australian Patent Office, International Search Report, PCT/AU2016/050532, dated Jun. 23, 2016

*Primary Examiner* — Nyca T Nguyen
(74) *Attorney, Agent, or Firm* — Hamilton, Brook, Smith & Reynolds, P.C.

(57) ABSTRACT

An exercise apparatus allowing freedom of movement of an exercise bar is provided. The exercise apparatus comprises one or more base assemblies; a pair of spaced vertical members mounted to the one or more base assemblies; and a first bar member mounted to the spaced vertical members, wherein the first bar member is at least partially rotatable relative to the longitudinal axes of the vertical members. The one or more base assemblies may facilitate multidirectional horizontal movement of the vertical members, whereby the first bar member is rotatable relative to the longitudinal axes of the vertical members.

19 Claims, 11 Drawing Sheets

(51) Int. Cl.

| | |
|---|---|
| ***A63B 21/02*** | (2006.01) |
| ***A63B 21/055*** | (2006.01) |
| ***A63B 24/00*** | (2006.01) |
| ***A63B 21/04*** | (2006.01) |
| ***A63B 21/00*** | (2006.01) |
| ***A63B 23/02*** | (2006.01) |
| ***A63B 22/18*** | (2006.01) |
| ***A63B 22/20*** | (2006.01) |
| ***A63B 23/035*** | (2006.01) |
| ***A63B 23/04*** | (2006.01) |
| ***A63B 23/12*** | (2006.01) |
| ***A63B 23/00*** | (2006.01) |
| ***A63B 21/008*** | (2006.01) |
| ***A63B 21/062*** | (2006.01) |
| ***A63B 1/00*** | (2006.01) |
| ***A63B 21/072*** | (2006.01) |
| ***A63B 21/078*** | (2006.01) |
| ***A63B 21/005*** | (2006.01) |
| ***A63B 71/00*** | (2006.01) |
| *A63B 22/02* | (2006.01) |
| *A63B 22/06* | (2006.01) |

(52) U.S. Cl.

CPC ..... *A63B 21/0628* (2015.10); *A63B 21/078* (2013.01); *A63B 21/0724* (2013.01); *A63B 21/0783* (2015.10); *A63B 21/151* (2013.01); *A63B 21/154* (2013.01); *A63B 21/4035* (2015.10); *A63B 21/4049* (2015.10); *A63B 23/1209* (2013.01); *A63B 23/1218* (2013.01); *A63B 71/0054* (2013.01); *A63B 22/203* (2013.01); *A63B 2023/0411* (2013.01); *A63B 2071/0081* (2013.01); *A63B 2209/08* (2013.01); *A63B 2220/53* (2013.01); *A63B 2220/801* (2013.01)

(58) Field of Classification Search

CPC ..... A63B 71/0054; A63B 23/1209; A63B 2209/08; A63B 2071/0081; A63B 21/0056; A63B 21/154; A63B 21/4049; A63B 21/0783; A63B 21/4035; A63B 23/1218; A63B 21/151; A63B 21/0724; A63B 1/00; A63B 22/203; A63B 2220/53; A63B 2220/801; A63B 2020/0411; A63B 2023/0411

See application file for complete search history.

(56) References Cited

U.S. PATENT DOCUMENTS 3,457,786 A * 7/1969 Trent ..... A63B 1/00 482/40
3,936,047 A * 2/1976 Brandt ..... A61H 1/003 482/146
4,349,192 A 9/1982 Lambert, Jr. et al.
4,487,413 A * 12/1984 Fall ..... A63B 21/0023 482/23
4,527,797 A * 7/1985 Slade, Jr. ..... A63B 21/0626 482/101
4,561,651 A * 12/1985 Hole ..... A63B 21/06 482/102
4,765,611 A 8/1988 MacMillan
4,795,149 A * 1/1989 Pearson ..... A63B 21/078 482/133
4,799,672 A * 1/1989 Barrett ..... A63B 21/078 482/104
4,836,535 A * 6/1989 Pearson ..... A63B 21/06 482/101
4,890,495 A * 1/1990 Slane ..... A63B 21/154 482/51
4,973,050 A * 11/1990 Santoro ..... A63B 21/00181 482/102
5,050,868 A * 9/1991 Pearson ..... A63B 21/0615 482/104
5,108,354 A * 4/1992 Becker ..... A63B 23/12 482/104
5,135,453 A 8/1992 Sollenberger
5,215,510 A * 6/1993 Baran ..... A63B 21/078 482/104
5,306,220 A * 4/1994 Kearney ..... A63B 23/00 482/104
5,314,394 A 5/1994 Ronan
5,346,448 A * 9/1994 Sollo ..... A63B 21/00181 482/104
5,468,203 A * 11/1995 Okonkwo ..... A63B 21/078 248/125.2
5,669,859 A * 9/1997 Liggett ..... A63B 21/078 482/101
5,716,306 A 2/1998 Gallay
5,725,459 A * 3/1998 Rexach ..... A63B 21/0628 482/102
5,989,158 A 11/1999 Fredette
5,989,166 A * 11/1999 Capizzo ..... A63B 21/0783 482/1
D441,813 S * 5/2001 Ceppo ..... 482/104
6,592,498 B1 * 7/2003 Trainor ..... A63B 21/153 482/46
6,623,409 B1 * 9/2003 Abelbeck ..... A63B 21/078 482/101
6,685,601 B1 * 2/2004 Knapp ..... A63B 21/078 482/104
6,811,521 B1 * 11/2004 Musso ..... A63B 21/0626 482/104
6,926,649 B2 * 8/2005 Slawinski ..... A63B 21/00181 482/104
7,001,314 B1 * 2/2006 Hummer, Jr. .... A63B 21/00181 482/104
7,374,516 B2 * 5/2008 Lundquist ..... A63B 21/078 482/104
7,393,309 B2 * 7/2008 Webber ..... A63B 21/078 482/104
7,455,629 B2 * 11/2008 Abelbeck ..... A63B 21/078 482/101
7,488,277 B1 * 2/2009 Knapp ..... A63B 21/078 482/104
7,549,950 B1 * 6/2009 Lundquist ..... A63B 21/078 482/101
7,578,774 B1 * 8/2009 Zetterberg ..... A63B 1/00 482/112
7,635,322 B2 * 12/2009 Parrilla ..... A63B 21/078 482/104
7,666,124 B2 * 2/2010 Vaes ..... A63B 21/078 482/101
7,717,837 B2 5/2010 Florczak
7,815,555 B2 * 10/2010 Webber ..... A63B 21/0618 482/104
7,931,575 B2 * 4/2011 Rochford ..... A63B 21/04 482/148
8,047,972 B1 * 11/2011 Dean ..... A63B 1/005 482/101
8,057,368 B1 * 11/2011 Lyszczarz ..... A63B 21/156 482/103
8,231,509 B2 * 7/2012 Lundquist ..... A63B 21/075 482/94
8,328,698 B1 * 12/2012 Webber ..... A63B 21/078 482/104
8,444,537 B1 * 5/2013 Santoro ..... A63B 21/078 482/104
8,784,281 B2 * 7/2014 Johnson, III ..... A63B 21/0783 482/104
8,834,327 B1 * 9/2014 George, Jr. ..... A63B 23/1218 482/141
8,876,672 B2 * 11/2014 Schiano ..... A63B 21/078 482/104

(56) References Cited

U.S. PATENT DOCUMENTS 9,067,102 B2 * 6/2015 Poppinga ..... A63B 21/078
9,327,160 B2 * 5/2016 Tauriainen ..... A63B 21/078
9,427,612 B1 * 8/2016 Swanson ..... A63B 1/005
9,526,938 B2 * 12/2016 Chen ..... A63B 21/062
2002/0049123 A1 4/2002 Krull
2002/0091043 A1 * 7/2002 Rexach ..... A63B 21/156 482/98
2002/0183176 A1 * 12/2002 Read ..... A63B 22/0007 482/148
2003/0017918 A1 * 1/2003 Webb ..... A63B 21/154 482/94
2004/0110612 A1 * 6/2004 Read ..... A63B 22/0007 482/142
2004/0157711 A1 * 8/2004 Regev ..... A63B 21/06 482/142
2005/0202941 A1 * 9/2005 Vaes ..... A63B 21/078 482/94
2005/0272573 A1 * 12/2005 Carter ..... A63B 21/15 482/99
2006/0194678 A1 8/2006 Turner
2007/0037674 A1 * 2/2007 Finn ..... A63B 21/156 482/97
2007/0042876 A1 * 2/2007 Lundquist ..... A63B 21/078 482/94
2007/0049472 A1 * 3/2007 Hummer, Jr. ..... A63B 71/0036 482/104
2007/0203002 A1 * 8/2007 Webber ..... A63B 21/078 482/104
2009/0137368 A1 * 5/2009 Parrilla ..... A63B 21/078 482/104
2010/0216610 A1 * 8/2010 Gedeon-Janvier ... A63B 21/072 482/94
2011/0028281 A1 * 2/2011 Ish, III ..... A63B 21/156 482/95
2012/0004080 A1 * 1/2012 Webb ..... A63B 21/00065 482/97
2014/0256517 A1 * 9/2014 Poppinga ..... A63B 21/078 482/104
2015/0306443 A1 * 10/2015 Bruni, Jr. ..... A63B 21/078 482/104
2016/0107022 A1 * 4/2016 Williams ..... A63B 21/0628 482/101
2016/0144230 A1 * 5/2016 An ..... A63B 23/1218 482/40
2017/0007876 A1 * 1/2017 Lu ..... A63B 21/0626

* cited by examiner

EXERCISE APPARATUS WITH MOVABLE VERTICAL MEMBERS

FIELD OF THE INVENTION

The present invention relates to an exercise apparatus. More particularly, the invention relates, but is not limited, to a weightlifting exercise apparatus which provides improved freedom of movement for a user as compared to one or more existing apparatuses.

BACKGROUND OF THE INVENTION

Weightlifting exercise apparatuses with guided exercise bars, such as 'Smith machines' comprise exercise bars attached to guides. Smith machines can offer improved safety as compared to free weight exercises, and may also allow for exercises to be performed without the need for an assistant or 'spotter'.

Generally, a Smith machine has an exercise bar attached to slide mechanisms which run on vertical guides on opposite sides of a stationary frame. This allows an exerciser to perform exercises with up-and-down movement, such as squats and bench presses, but does not permit horizontal movement.

More recently, 'dual-action' Smith machines that allow both horizontal and vertical exercise motion have been developed. Generally, such designs allow the exercise bar to follow a front-to-back exercise motion as well as the up-and-down motion and so facilitate exercise that more closely resembles the use of free weights, as well as enabling exercises, such as lunges, which require horizontal as well as vertical movement.

However, neither traditional nor dual-action Smith machines allow for rotatable movement of a bar relative to a vertical axis. Therefore, these machines do not properly replicate the freedom of movement associated with exercises performed with free weights, for example bench presses, squats, and lunge exercises, using a free barbell. Such exercises require a user to stabilize and control the bar in use, which can provide an improved workout that increases stimulation of muscles, and/or stimulates an increased number of muscle groups.

OBJECT OF THE INVENTION

It is an aim of this invention to provide an exercise apparatus which overcomes or ameliorates one or more of the disadvantages or problems described above, or which at least provides a useful alternative. Other preferred objects of the present invention will become apparent from the following description.

SUMMARY OF INVENTION

In one form, although it need not be the only or indeed the broadest form, there is provided an exercise apparatus comprising:

one or more base assemblies;

a pair of spaced vertical members mounted to the one or more base assemblies; and a first bar member mounted to the spaced vertical members;

wherein the first bar member is at least partially rotatable relative to the longitudinal axes of the vertical members.

Preferably, the one or more base assemblies facilitate multidirectional horizontal movement of the vertical members, whereby the first bar member is rotatable relative to the longitudinal axes of the vertical members.

Preferably, the one or more base assemblies facilitate horizontal movement of the vertical members in a first horizontal plane.

Preferably, the one or more base assemblies facilitate horizontal movement of the vertical members in a second horizontal plane.

In a preferred form, the first bar member is slidably mounted to the spaced vertical members, and vertically movable relative to the longitudinal axes of the vertical members.

In a preferred form, the first bar member is slidably mounted to one or more rails of each of the vertical members.

Preferably, the one or more base assemblies comprise: one or more vertical member mounting portions; one or more movable horizontal member portions; and one or more stationary horizontal member portions.

Preferably, each of the vertical members is rigidly mounted to a respective vertical member mounting portion.

Preferably, the vertical members are horizontally movable relative to the one or more stationary horizontal member portions. Preferably, the vertical members are horizontally movable relative to the one or more movable horizontal member portions.

Preferably, the vertical member mounting portion for each of the vertical members is engaged with a respective movable horizontal member portion.

Preferably, the movable horizontal member portion has a longitudinal axis that extends in a first horizontal direction. In a preferred form, the vertical member mounting portion is slidably engaged with the movable horizontal member portion and slidable in a direction substantially parallel to the longitudinal axis of the movable horizontal member portion.

Preferably, the vertical member mounting portion is slidably engaged with one or more rails of the movable horizontal member portion.

Preferably each of the one or more base assemblies comprises a pair of stationary horizontal member portions. Preferably, each of the pair of stationary horizontal member portions comprises a longitudinal axis extending in a horizontal direction substantially perpendicular to the longitudinal axes of the one or more movable horizontal member portions of the base assembly, wherein the longitudinal axes of the pair of stationary horizontal member portions are substantially parallel.

In a preferred form, the one or more movable horizontal member portions of the base assembly are slidably engaged with the pair of stationary horizontal member portions. Preferably, the one or more movable horizontal member portions are slidable in a direction substantially parallel to the longitudinal axes of the pair of stationary horizontal member portions.

Preferably, the one or more movable horizontal member portions are engaged with one or more rails of the pair of stationary horizontal member portions.

Preferably each of the opposed ends of the movable horizontal member portion is engaged with one of the paired stationary member portions, respectively.

Preferably, the one or more base assemblies comprise one or more locking mechanisms. Preferably, the one or more locking mechanisms constrain horizontal movement of the vertical members relative to the stationary horizontal members. Preferably, the one or more locking mechanisms constrain horizontal movement of the vertical members relative to the movable horizontal members.

Preferably, for each of the spaced vertical members, respectively, the one or more base assemblies comprise two locking mechanisms. Preferably, the first locking mechanism constrains horizontal movement of the respective vertical member mounting portion relative to the respective movable horizontal member portion. Preferably the second locking mechanism constrains horizontal movement of the respective movable horizontal member portion relative to the respective pair of stationary horizontal member portions.

In one preferred form, one or more of the locking mechanisms of the exercise apparatus is an electromagnet locking mechanism. Preferably, actuation of one or more actuators of the exercise apparatus results in locking of the one or more respective electromagnet locking mechanisms.

Preferably, the exercise apparatus comprises a pair of base assemblies, wherein each of the spaced vertical members is mounted to a respective base assembly.

Preferably, for each of the pair of base assemblies, the longitudinal axis of the movable horizontal member portion is substantially longer than the longitudinal axes of the pair of stationary member portions.

Preferably, the respective base assemblies are connected by one or more stabilising members.

Preferably, the first bar member is mounted to the paired vertical members by respective bar mounting assemblies. In a preferred form, the bar mounting assemblies comprise a vertical member engaging portion and a first bar member engaging portion. The bar mounting assemblies may further comprise a connecting member engaging portion.

Preferably the respective bar mounting assemblies facilitate vertical movement of the first bar member with respect to the longitudinal axis of the respective vertical member. Preferably, the respective bar mounting assemblies allow rotatable movement of the first bar member about the longitudinal axis of the respective vertical member.

Preferably, the vertical member engaging portions of the respective bar mounting assemblies are slidably engaged with the respective vertical member. Preferably the vertical member engaging portions of the respective bar mounting assemblies are rotatably engaged with the respective vertical member.

Preferably the vertical member engaging portions are slidably and rotatably engaged with one or more rails of the respective vertical member.

Preferably, the first bar member comprises a user engaging portion and two opposed load receiving ends. Preferably, the user engaging portion of the first bar member extends between the first bar member engaging portions of the respective bar mounting assemblies, and the respective load receiving ends of the first bar member extend outwardly from the bar member engaging portion of the respective bar mounting assemblies.

Preferably, the first bar member is received by respective apertures of the bar member engaging portions of the respective bar mounting assemblies. In another preferred form, the first bar member is received by respective channels of the bar member engaging portions of the respective bar mounting assemblies.

The exercise apparatus may further comprise one or more load receiving assemblies. Preferably, the one or more load receiving assemblies are capable of operative association with the first bar member.

Preferably, the one or more load receiving assemblies are capable of operative association with the first bar member in a counterbalance arrangement.

Preferably the one or more load receiving assemblies comprise a vertical member engaging portion and one or more load receiving portions. Preferably, the one or more load receiving assemblies comprise a connecting member engaging portion. Preferably, the one or more load receiving assemblies comprise a user engaging portion.

In a preferred embodiment, the one or more load receiving assemblies are slidably mounted to the vertical members. Preferably the one or more load receiving assemblies are vertically slidable in relation to the longitudinal axes of the vertical members. Preferably, the vertical member engaging portion of each of the one or more load receiving assemblies is slidably engaged with one or more rails of the vertical members.

Preferably, the respective vertical member engaging portions of the one or more load receiving assemblies are slidably engaged with the respective vertical member in an opposite position, relative to the vertical member engaging portion of the respective bar mounting assembly for the first bar member.

In a preferred embodiment, a connecting member engaging portion of each of the one or more load engaging assemblies is capable of operative connection by a respective connecting member to a respective connecting member engaging portion of a bar mounting assembly for the first bar member.

Preferably, the connecting member is releasably connectable to one or more of the connecting member engaging portions.

Preferably, a respective operatively connectable load receiving assembly and bar mounting assembly for the first bar member are mounted to the same vertical member.

Preferably, the respective connecting members are capable of operative engagement with one or more respective pulley assemblies. Preferably, the respective connective members are operatively engaged with at least two pulley assemblies.

Preferably, one of the pulley assemblies is mounted on the upper end of the respective vertical member. Preferably, one of the pulley assemblies is mounted substantially towards the vertical member engaging portion of the one or more base assemblies.

Preferably, the exercise apparatus comprises a pair of load receiving assemblies. Preferably, each of the pair of load receiving assemblies comprises a user engaging portion.

Preferably, each of the pair of load engaging assemblies comprises a user engaging portion that is a bar member. Preferably, the bar member comprises an inner end and an outer end. Preferably, the respective inner ends of the pair of bar members are positioned inwardly facing.

In a preferred embodiment, the bar members are slidably engaged with a bar member mounting portion of the respective load receiving assemblies, such that the bar members are capable of linear movement to increase or decrease the proximity of the respective inner ends.

Preferably, the exercise apparatus comprises one or more locking mechanisms capable of constraining vertical movement of the first bar member and/or the load receiving assemblies relative to the vertical members.

Preferably, the one or more locking mechanisms comprise an actuator and an engaging member operatively engaged with the actuator.

In an embodiment, the actuator can be actuated by rotation of the first bar member about its longitudinal axis.

In an embodiment, the actuator can be actuated via movement of an actuating cable.

Preferably, upon actuation of the actuator, the engaging member engages or disengages with one or more apertures of the respective vertical member, to thereby lock or unlock the locking mechanism.

Preferably, the exercise apparatus comprises one or more locking mechanisms capable of constraining vertical movement of the first bar member according to the directly preceding embodiments, wherein the one or more actuators and the one or more engaging members of the locking mechanism are mounted to the first bar member mounting assemblies.

Preferably, the exercise apparatus comprises one or more locking mechanisms capable of constraining vertical movement of the load receiving assemblies relative to the vertical members according to the directly preceding embodiments, wherein the one or more actuators and the one or more engaging members of the locking mechanism are mounted to the load receiving assemblies.

In another embodiment, the exercise apparatus comprises a locking mechanism in the form of a pair of vertically spaced engaging members mounted to the first bar member, and a plurality of pairs of spaced catches attached to the pair of spaced vertical members.

Preferably, the spaced catches extend inwardly from the vertical members. Preferably, the pair of engaging members are capable of engaging with any one of the pairs of spaced catches, by rotation of the first bar member about its longitudinal axis.

Preferably, the exercise apparatus further comprises an upper bar assembly. Preferably, the upper bar assembly comprises paired mounting portions; and one or more bar member portions.

Preferably the upper bar assembly further comprises one or more user engaging portions. In a preferred form the upper bar assembly comprises paired user engaging portions.

Preferably, the paired mounting portions of the upper bar assembly are mounted to the respective upper ends of the spaced vertical members. Preferably, each of the paired mounting portions are rotatable relative to the longitudinal axis of the respective vertical member.

Preferably, each of the paired mounting portions are rotatably engaged with a rail of the respective vertical members.

Preferably the longitudinal axes of the one or more bar members extend through the paired mounting portions mounted to the respective spaced vertical members. Preferably, the opposed ends of the one or more bar members extend outwardly beyond the spaced vertical members.

In some embodiments, the one or more bar members may be slidably engaged with the paired mounting portions.

Preferably, the upper bar assembly comprises two bar member portions. Preferably the bar member portions are parallel and vertically spaced.

In a preferred embodiment the paired user engaging portions are horizontally spaced and mounted to the one or more bar members. Preferably the paired user engaging portions are slidably mounted to at least one of the one or more bar members. Preferably the respective user engaging portions comprise a user engaging member.

In another form of the invention, there is provided a method of manoeuvring one or more bar members mounted to a pair of spaced vertical members, wherein the one or more bar members may be rotated relative to the longitudinal axes of the spaced vertical members, and the one or more bar members may be moved horizontally and vertically.

Preferably, the spaced vertical members are mounted to one or more base assemblies, and the one or more base assemblies facilitate multidirectional horizontal movement of the spaced vertical members whereby Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
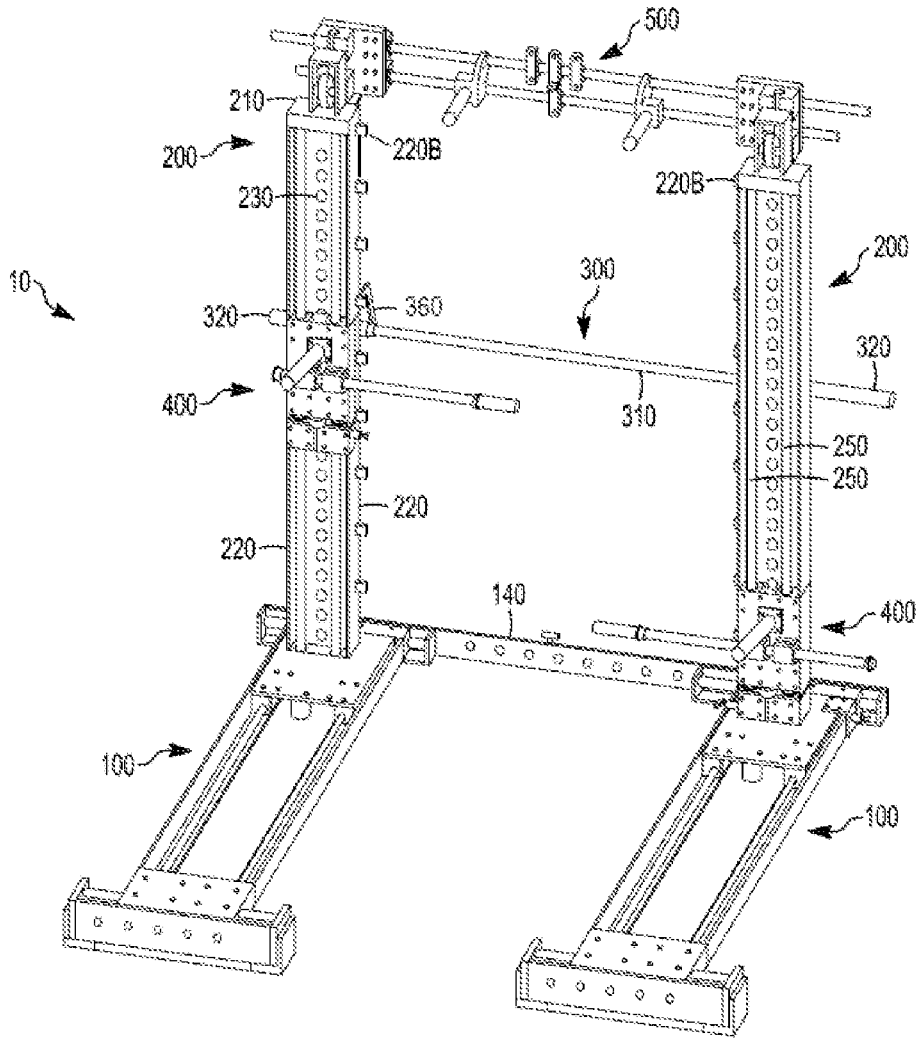
FIG. 1 illustrates a perspective view of an exercise apparatus according to an embodiment of the invention.

FIG. 1 illustrates an exercise apparatus 10. The exercise apparatus 10 has paired base assemblies 100, paired spaced vertical members 200, a first bar member 300, paired load receiving assemblies 400, and an upper bar assembly 500.

Figure 5:
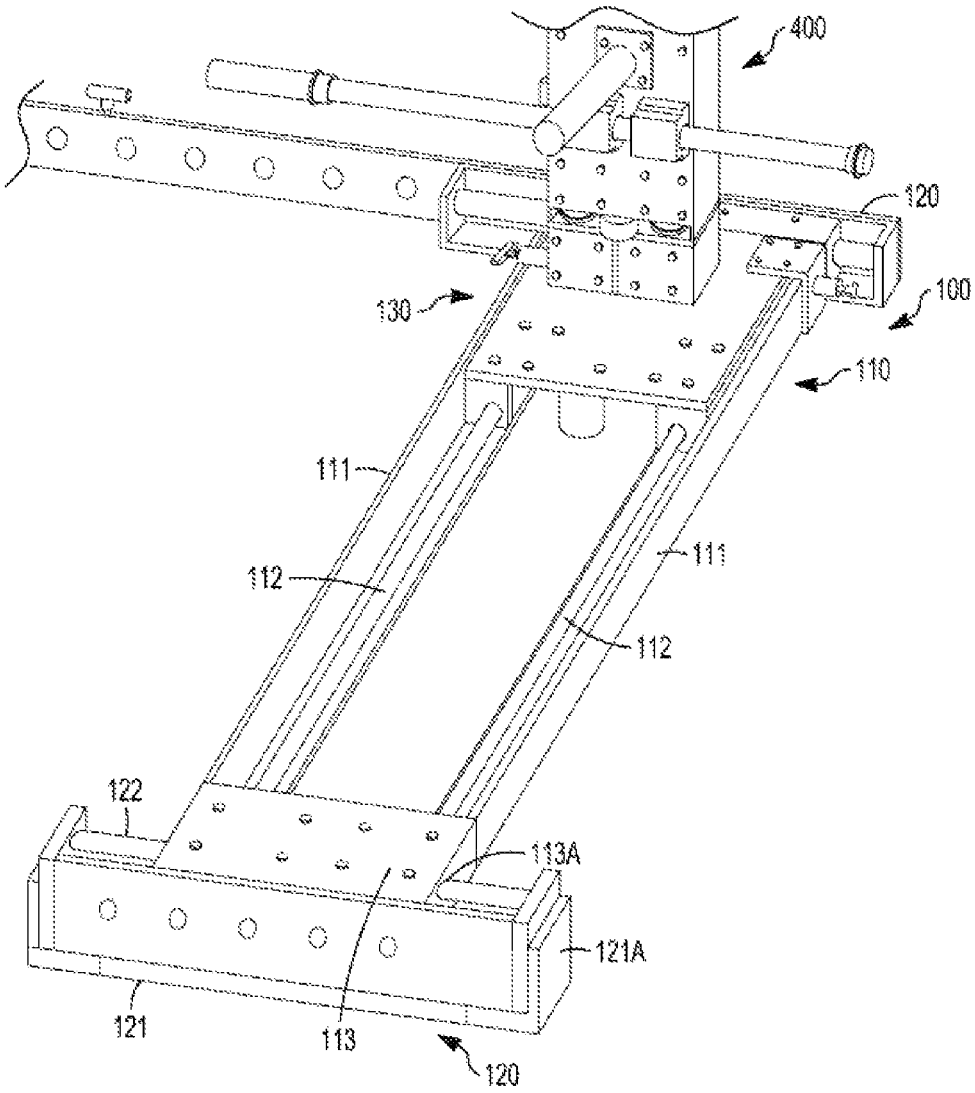
FIG. 5 illustrates a perspective view of a base assembly of the exercise apparatus illustrated in FIG. 1.

As seen most clearly in FIG. 5, each of the paired base assemblies 100 comprise a movable horizontal member portion 110, paired stationary horizontal member portions 120, and a vertical member mounting portion 130.

In a preferred form, seen most clearly in FIG. 1, the paired base assemblies are connected by a base assembly support 140.

As best seen in FIG. 5, each of the respective movable horizontal member portions 110 comprises: a pair of movable horizontal member supports 111; a pair of movable horizontal member rails 112; and a pair of movable horizontal member channel blocks 113.

The longitudinal axes of the movable horizontal member supports 111 and the movable horizontal member rails 112 are substantially parallel to the longitudinal axis of the base assembly 110.

The longitudinal axes of the movable horizontal member channel blocks 113 are substantially perpendicular to the longitudinal axes of the movable horizontal member rails 112.

The movable horizontal member supports 111 are angle supports. The vertical position of the movable horizontal member rail 112 is between the outer longitudinal edges of the vertical face of the respective movable horizontal member support 111. The horizontal position of the movable horizontal member rail 112 is between the outer longitudinal edges of the horizontal face of the respective movable horizontal member support 111.

The opposed ends of the movable horizontal member supports 111 are rigidly attached to the respective movable horizontal member channel blocks 113.

The opposed ends of the movable horizontal member rails 112 are rigidly attached to the respective movable horizontal member channel blocks 113.

Figure 3:
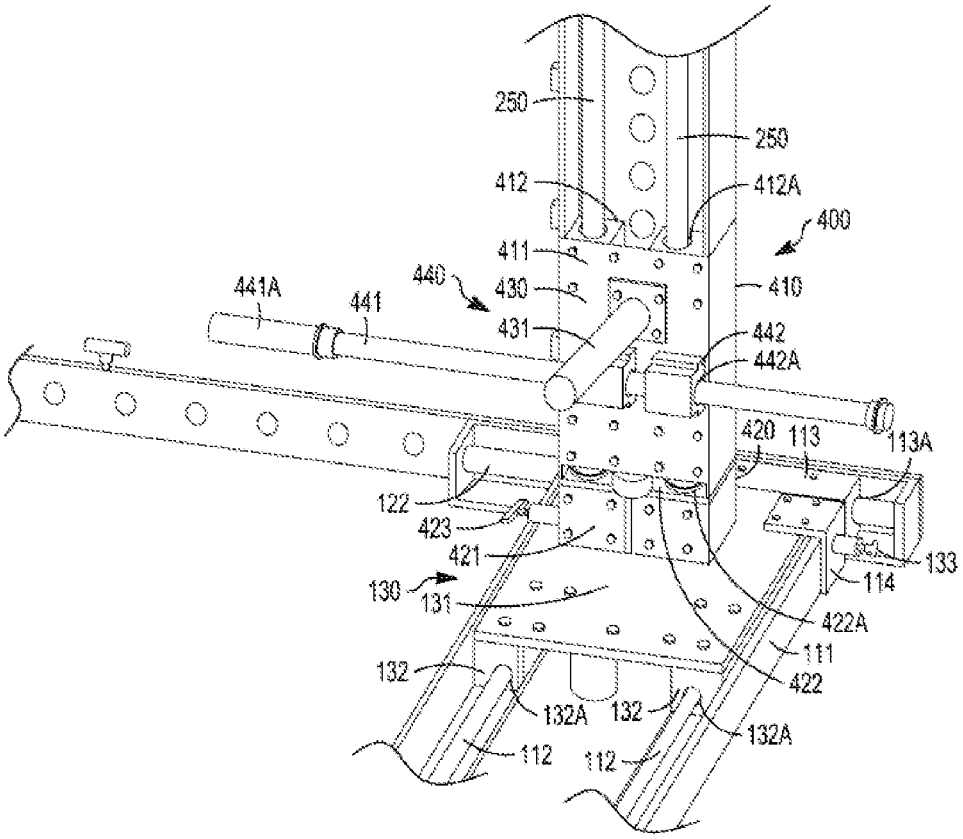
FIG. 3 illustrates a perspective view of a load receiving assembly and a vertical member mounting assembly of the exercise apparatus illustrated in FIG. 1.

As seen most clearly in FIGS. 3 and 5 each of the respective movable horizontal member channel blocks 113 comprises a channel 113A. The respective channels 113A have a longitudinal axis substantially perpendicular to the longitudinal axes of the movable horizontal member rails 112. As pictured in FIGS. 3 and 5 the channel 113A is a cylindrical channel, although it will be appreciated that the channel could also take other forms, e.g. an elongate cuboidal channel.

As seen most clearly in FIGS. 3 and 5, each of the respective stationary member portions 120 comprises a stationary member support 121 and a stationary member rail 122. The longitudinal axes of the stationary member support 121 and the stationary member rail 122 are substantially perpendicular to the longitudinal axes of the movable horizontal member rails 112. In a preferred form, the respective pairs of stationary member portions 120 comprise one or more locking mechanisms (not shown). In one preferred embodiment the one or more locking mechanisms are electromagnet locking mechanisms.

The stationary member supports 121 comprise an angle support and paired vertical end plates 121A. The vertical position of the stationary member rail 122 is between the outer longitudinal edges of the vertical face of the stationary member support 121. The horizontal position of the stationary member rail 122 is between the outer longitudinal edges of the horizontal face of the stationary member support 121.

In a preferred form the opposed ends of the stationary member rails 122 are rigidly attached to each of the respective vertical end plates 121A.

The respective ends of each of the movable horizontal member portions 110 are slidably mounted to the respective pairs of stationary horizontal member portions 120, with the respective stationary horizontal member rails 122 received by the channels 113A of the respective movable horizontal member mounting portion channel blocks 113.

As seen most clearly in FIG. 3, the vertical member mounting portion 130 comprises a vertical member mounting portion plate 131 and paired vertical member mounting portion channel blocks 132. Each of the vertical member mounting portion channel blocks 132 comprises a channel 132A. The respective channels 132A have a longitudinal axis substantially parallel with the longitudinal axis of the movable horizontal member rails 112. As pictured in FIG. 3 the channel 132A is a cylindrical channel, although it will be appreciated that the channel could also take other forms, e.g. an elongate cuboidal channel.

The vertical member mounting portions 130 further comprise a locking mechanism 133. As pictured in FIG. 3 the locking mechanism is a bolt locking mechanism, but it will be appreciated that the locking mechanism can take other forms. In one preferred alternative embodiment the locking mechanism is an electromagnet locking mechanism.

The vertical member mounting portions 130 are slidably mounted to the movable horizontal member 110, with the respective movable horizontal member rails 112 received by the channels 132A of the respective vertical member mounting portion channel blocks 132.

Figure 2:
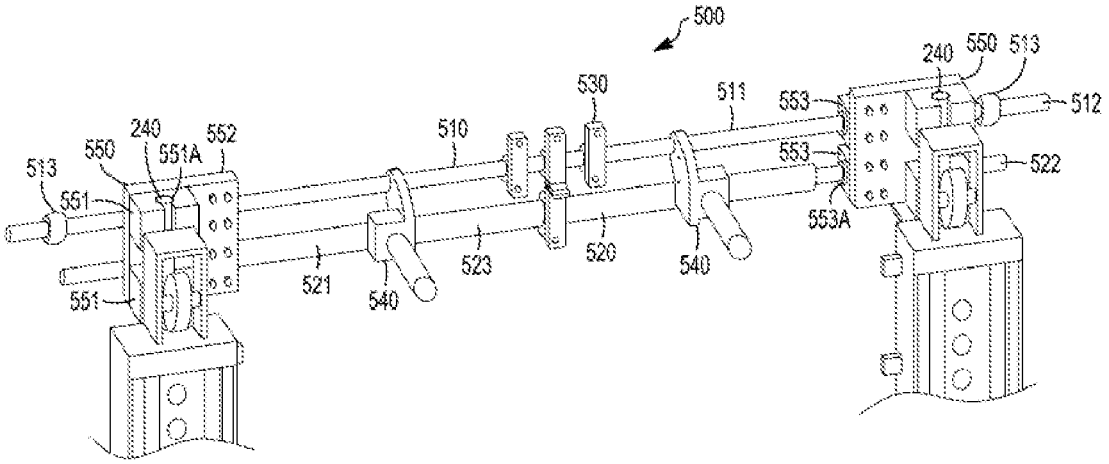
FIG. 2 illustrates a perspective view of an upper bar assembly of the exercise apparatus illustrated in FIG. 1.

As seen most clearly in FIGS. 1 and 2, each of the spaced vertical members 200 comprises an upper end portion 210, a pair of vertical member support portions 220, an internal web portion 230, a first vertical member mounting rail portion 240, and a pair of vertical member mounting rail portions 250.

The respective faces of the pair of vertical member support portions 220 are opposed in a horizontal plane that is substantially perpendicular to the longitudinal axes of the movable horizontal member rails 112 of the respective base assembly 100. The internal web portion 230 extends between the faces of the vertical member support portions 220. The respective faces of the internal web portion 230 and the vertical member support portions 220 are substantially perpendicular.

The longitudinal axes of the first vertical member mounting rail portion 240 and the pair of vertical member mounting rail portions 250 are substantially parallel to the longitudinal axes of the vertical member support portions 220.

The first vertical member mounting rail portion 240 and the pair of vertical member mounting rail portions 250 are located on opposite sides of the face of the internal web portion 230.

Figure 7:
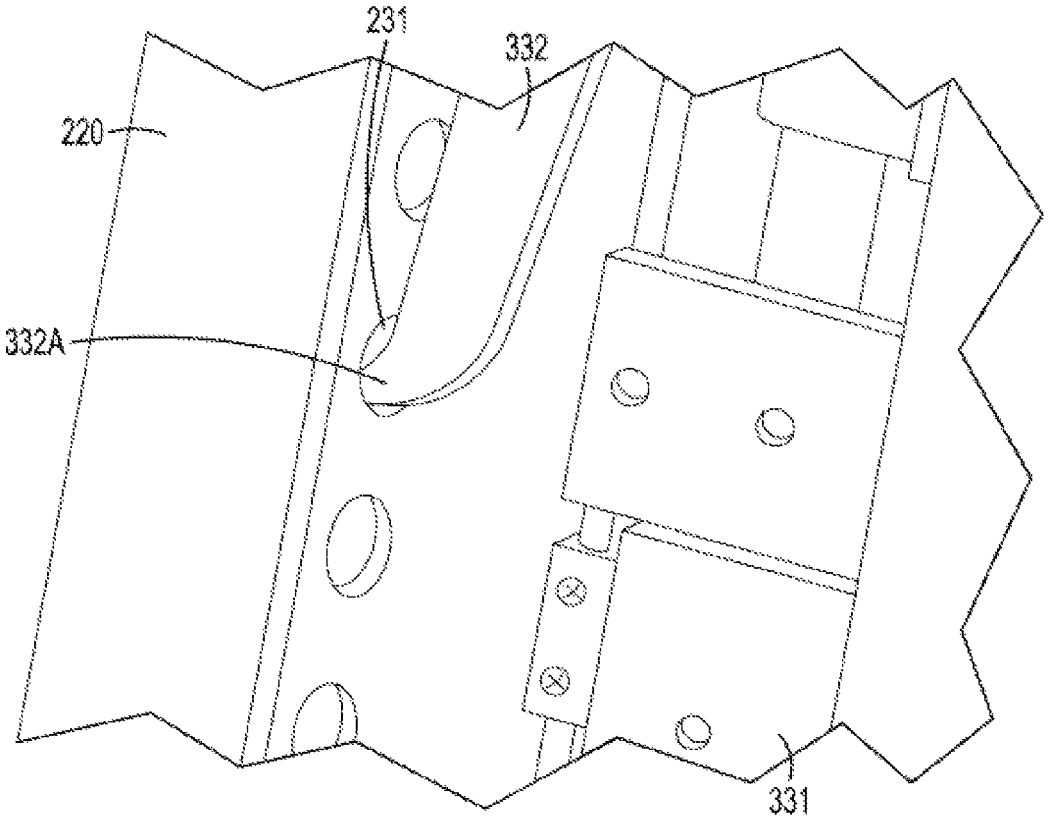
FIG. 7 illustrates a perspective view of a locking mechanism for a first bar member according to an embodiment of the invention.

As seen in most clearly in FIG. 7, the face of the internal web portions 230 comprise a plurality of vertically spaced apertures 231.

Figure 4:
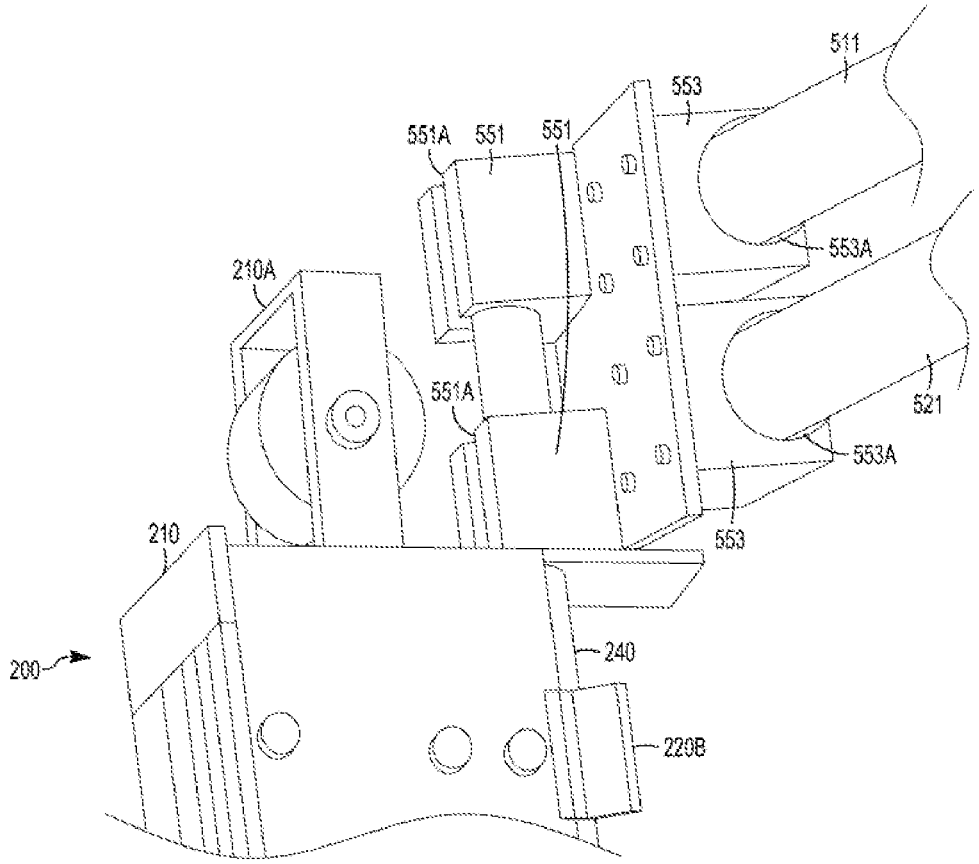
FIG. 4 illustrates a perspective view of an upper bar assembly mounting portion and a pulley member mounted to the upper end of a spaced vertical member of the exercise apparatus illustrated in FIG. 1.

As pictured in FIG. 4, the first vertical member mounting rail portion 240 is preferably located outside of the space between the respective faces of the paired vertical member support portions 220. However, it will be appreciated that in another form the first rail portion 240 can be located between the faces of the paired vertical member support portions 220.

As pictured in FIG. 3, the pair of vertical member mounting rail portions 250 is located within the space between the faces of the paired vertical member support portions 220. However, it will be appreciated that in another form the pair of vertical member rail mounting portions 250 may be located outside of the space between the faces of the vertical member paired support portions 220.

As best seen in FIG. 4, a pulley 210A is mounted to the respective upper end portions 210 of the respective vertical members 200.

Figure 11:
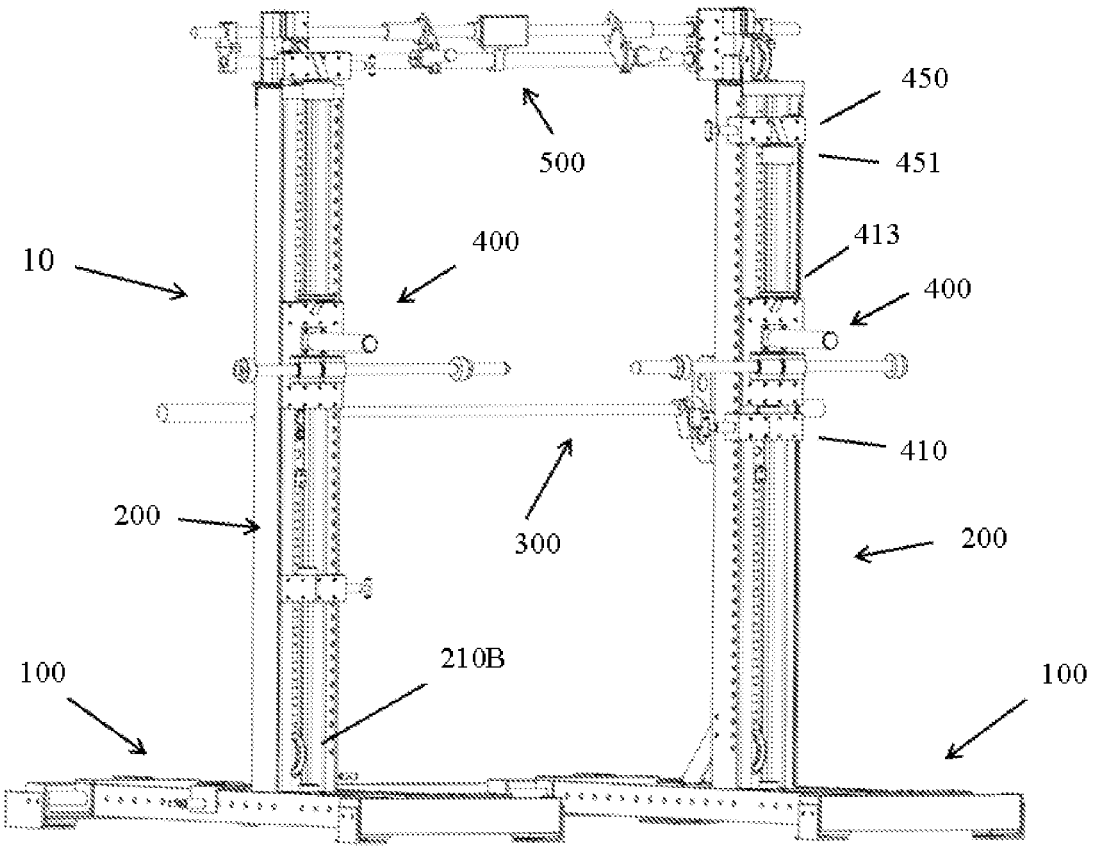
FIG. 11 illustrates a second perspective view of the exercise apparatus of FIG. 10.

In a preferred form, as best seen in FIG. 11, an internal pulley 210B is located between the faces of the vertical member supports. Preferably the pulley is located substantially towards the vertical member mounting assembly 130 of the respective base assembly 100.

The pulleys of the respective vertical members 200 are capable of operative engagement with a connecting member, e.g. a cable or rope (not shown).

In one form, as depicted in FIG. 1, the respective inner faces of the respective pairs of vertical member supports 220 further comprise a plurality of pairs of spaced vertical catches 220B.

Figure 6:
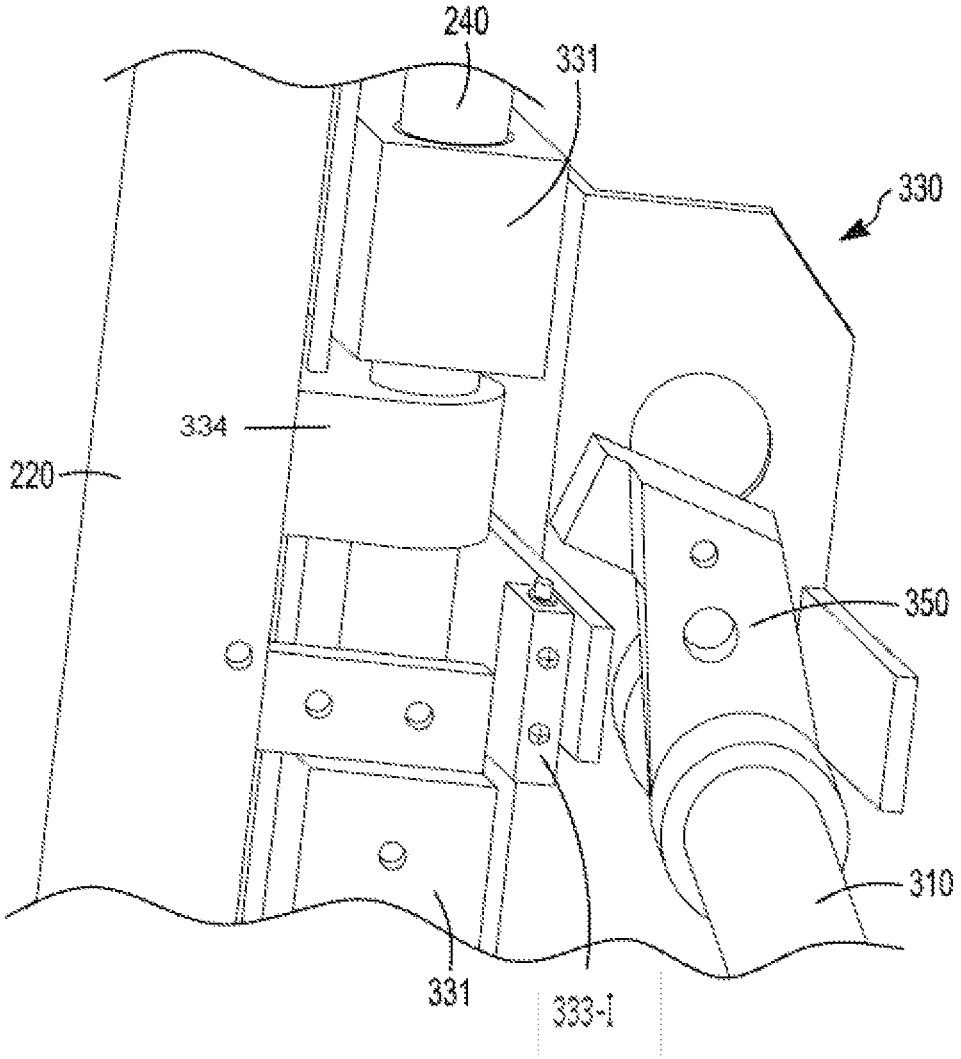
FIG. 6 illustrates a perspective view of a hammer actuator according to an embodiment of invention.

As seen in FIG. 6, the first bar member 300 is mounted to the respective vertical members by a pair of first bar member bar mounting assemblies 330. The first bar member mounting assembly comprises a first bar member engaging portion and a pair of vertically spaced bar member mounting assembly channel blocks 331. The first bar member mounting assembly 330 may further comprise a connecting member engaging portion 334.

The first bar member 300 is rotatably engaged with respective apertures of the first bar member engaging portion, and rotatable about its longitudinal axis.

The respective first bar member mounting assemblies are slidably and rotatably mounted to the respective vertical member 200. The respective first mounting rail portion 240 is engaged with the pair of first bar member channel blocks 331.

The first bar member 300 has a first bar member user engaging portion 310 and first bar member load receiving portions 320.

The first bar member user engaging portion 310 of the first bar member 300 extends between the respective first bar member mounting assemblies 330. The load receiving portions 320 of the first bar member 300 extend outwardly from the respective bar mounting assemblies.

In one embodiment, best seen in FIGS. 6 and 7, the first bar member 300 comprises one or more hammers 350, and switch 333 is in a first form 333-I. The hammers 350 are mounted to the first bar member user engaging portion 310 substantially towards the respective first bar member mounting assemblies 330.

Figure 8:
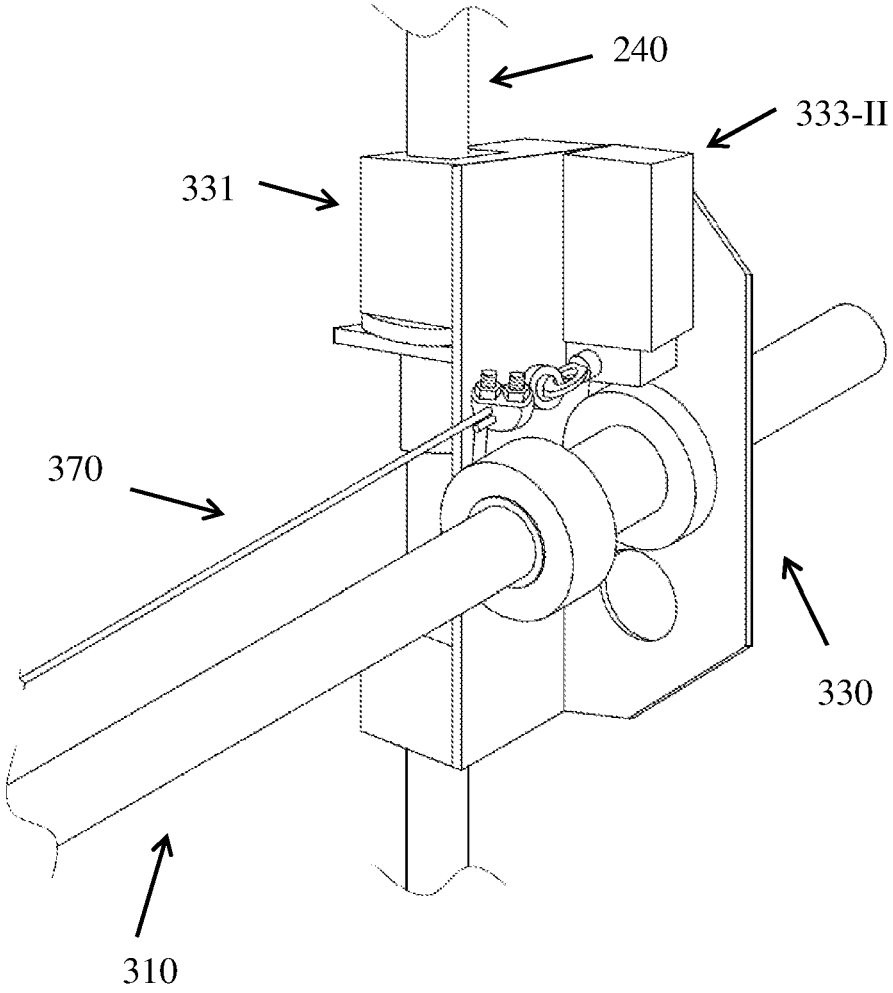
FIG. 8 illustrates a perspective view of an actuating cable according to an embodiment of the invention.

In another embodiment, best seen in FIG. 8, the first bar member 300 comprises an actuating cable 370, and switch is in a second form 333-II. The actuating cable 370 is biased towards a position distal from bar member user engaging portion 310, as depicted in FIG. 8, but is moveable to a position against bar member user engaging portion 310 upon the application of suitable force.

In certain embodiments, best seen in FIGS. 6-8, one or more of the first bar member mounting assemblies 330 comprise a locking mechanism comprising an engaging member 332, a switch 333, and an actuator in the form of a linear solenoid (not shown). As depicted, the engaging member 332 is in the form of a hook comprising an aperture engaging end 332A, although it will be appreciated that in alternative embodiments the engaging member may take other forms.

In another embodiment (best seen in FIG. 1), the first bar member 300 comprises a locking mechanism comprising one or more hook members 360, engageable with a plurality of catches 220 extending from one or more of the vertical members 200. The hook members 360 are mounted to the first bar member user engaging portion 310 substantially towards the respective first bar member mounting assemblies.

As best seen in FIG. 3, each of the respective load receiving assemblies 400 comprises a main load receiving assembly vertical member engaging portion 410, a lower accessory vertical member engaging portion 420, a load receiving assembly load receiving portion 430, a load receiving assembly user engaging portion 440, and one or more load receiving assembly connecting member engaging portions (not shown).

Optionally, as best seen in FIG. 11, the load receiving assembly member may further comprise an upper accessory vertical member engaging portion 450, which may be substantially the same as the lower accessory vertical member engaging portion 420, but positioned above the main load receiving assembly vertical member engaging portion 410.

The main load receiving assembly vertical member engaging portion 410 and the lower accessory vertical member engaging portion 420 comprise load receiving assembly plate members 411 and 421, respectively, and pairs of load receiving assembly channel members 412 and 422, respectively. The pairs of load receiving assembly channel members 412 and 422 comprise respective channels 412A and 422A.

The respective load receiving assemblies 400 are slidably mounted to the respective pair of vertical member mounting rail portions 250 of the respective vertical members 200, with the respective pair of vertical member rail mounting portions 250 passing through the respective pairs of channels 412A and 422A.

The one or more accessory vertical member engaging portions are releasably connectable with the main load receiving assembly vertical member engaging portion 410.

In one form, the main load receiving assembly vertical member engaging portion 410 and/or the one or more accessory vertical member engaging portions comprise electromagnets. Upon actuation of the one or more electromagnets, the respective accessory vertical member engaging portions are capable of connection with the main load receiving vertical member engaging portion.

A preferred embodiment wherein the load receiving assembly comprises an upper accessory vertical member engaging portion 450, which comprises an electromagnet 451 for connection with the main load receiving assembly vertical member engaging portion 410, is depicted in FIG. 11. As pictured in FIG. 11, in this embodiment, the main load receiving assembly vertical member 410 further comprises an electromagnet engaging portion, in the form of armature plate 413.

The respective load receiving assembly user engaging portions 440 comprise a user engaging bar 441 and a pair of user engaging portion channel blocks 442. The user engaging bars 441 comprise respective handle portions 441A. The user engaging portion channel blocks 442 comprise respective channels 442A.

The longitudinal axes of the respective user engaging bars 441 are substantially perpendicular to the longitudinal axes of the movable horizontal member rails 112 of the respective base assemblys 100.

The user engaging bar 441 is slidably mounted to the main load receiving assembly vertical member engaging portion 410. The user engaging portion channel blocks 442 are rigidly mounted to the plate member 411 of the main load receiving assembly vertical member engaging portion 410, with the user engaging bar 441 received by the channels 442A.

The load receiving assembly load engaging portion 430 comprises a load receiving bar 431. The load receiving bar 431 is rigidly attached to the plate member 411 of the main load receiving assembly vertical member engaging portion 410. The longitudinal axis of the load receiving bar 431 extends horizontally away from the internal web portion 230, in a direction substantially parallel to the longitudinal axes of the movable horizontal member rails 112 of the respective base assembly 100.

As pictured in FIG. 3, the respective lower accessory vertical member engaging portions 420 comprise a locking mechanism 423. Optionally, the main load receiving assembly vertical member engaging portion 410 and/or the upper accessory vertical member engaging portion also comprise locking mechanisms.

As pictured in FIG. 3 the locking mechanism 423 is a bolt locking mechanism, however it will be appreciated that the one or more locking mechanisms of the main vertical member engaging portion 410 and/or the one or more accessory vertical member engaging portions may take other forms. In one preferred alternative form, the one or more locking mechanisms are electromagnet locking mechanisms.

Figure 9:
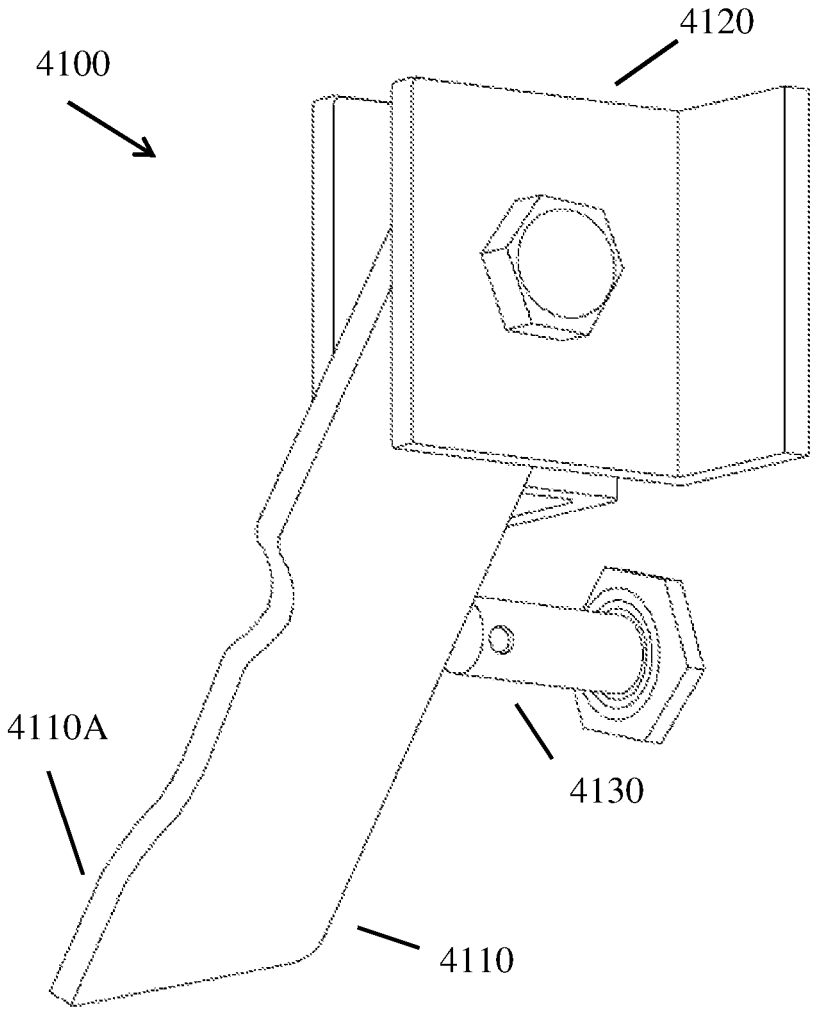
FIG. 9 illustrates a perspective view of a locking mechanism for a load receiving device according to an embodiment of the invention.
Figure 10:
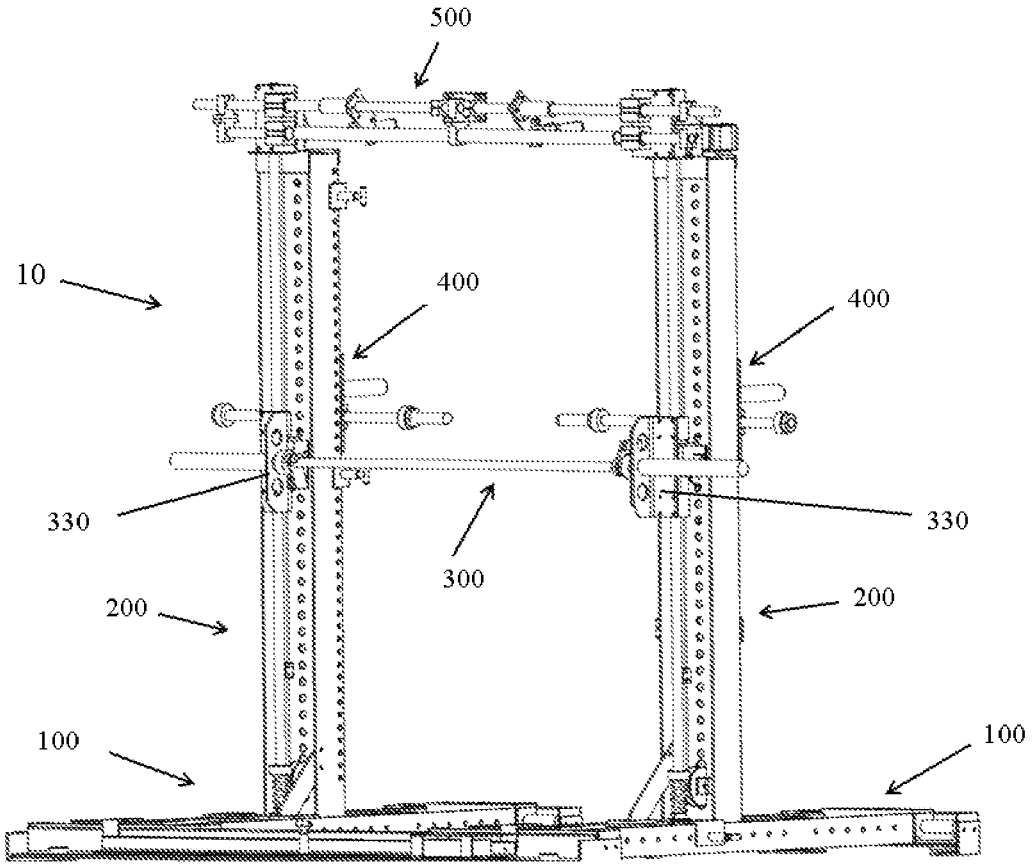
FIG. 10 illustrates are first perspective view of an exercise apparatus according to an embodiment of the invention.

In some preferred embodiments, the main load receiving assembly vertical member engaging portion 410 comprises load receiving locking mechanism 4100, as depicted in FIG. 9.

Load receiving locking mechanism 4100 is mounted to plate member 411 of main load receiving assembly vertical member engaging portion 410, on the same face of plate member 411 as channel member 412.

Load receiving assembly locking mechanism 4100 comprises load receiving assembly locking mechanism engagement member 4110 comprising aperture engaging end 4110A, load receiving assembly locking mechanism support 4120, and load receiving assembly locking mechanism linear solenoid 4130. Load receiving assembly locking mechanism engagement member 4110 is rotatably connected to load receiving assembly locking mechanism support 4120 by a fastener, which may be a bolt, as depicted in FIG. 9. Load receiving assembly locking mechanism linear solenoid 4130 is engageable with load receiving assembly locking mechanism engagement member 4110.

As best seen in FIG. 2, the upper bar assembly 500 comprises an upper bar 510, a lower bar 520, a bar stabilizing portion 530, a pair of horizontally spaced upper bar assembly user engaging portions 540, and a pair of upper bar assembly mounting portions 550. The longitudinal axes of the upper bar and the lower bar are parallel and positioned in substantially the same vertical plane.

The respective upper bar assembly mounting portions 550 comprise a pair of mounting rail engaging channel blocks 551, an upper bar assembly plate member 552, and a pair of upper bar assembly bar engaging channel blocks 553. The pairs of mounting rail engaging channel blocks 551 and upper bar assembly bar engaging channel blocks 553 comprise respective channels 551A and 553A.

The channels 551A extend substantially vertically through the respective mounting rail engaging channel blocks 551. The channels 553A extend substantially horizontally through the respective upper bar assembly bar engaging channel blocks 553.

The upper bar 510 and the lower bar 520 comprise respective inner portions 511 and 521, and respective outer portions 512 and 522. The inner portions 511 and 521 extend between the respective pairs of upper bar assembly mounting portions 550. The outer portions 512 and 522 extend outwardly from the respective pairs of upper bar assembly mounting portions 550.

As pictured in FIG. 2, the upper bar 510 optionally further comprises a pair of upper bar stops 513 mounted to the respective outer portions 512. As pictured in FIG. 2, the lower bar 520 optionally further comprises a lower bar cover 523 partially covering the inner portion 521 of the lower bar 520.

As pictured, the upper bar 510 and the lower bar 520 are slidably engaged with the respective pairs of upper bar assembly bar engaging channel blocks 553, with the upper bar 510 and the lower bar 520 received by the respective channels 553A.

The upper bar assembly 500 is rotatably engaged with the vertical members 200, with the respective mounting rail portions 240 received by the respective channels 551A of the respective pairs of mounting rail engaging channel members 551.

The user engaging portions 540 of the upper bar assembly 500 are slidably engaged with the upper bar member 510 and supported by the lower bar member 520.

In use, the first bar member 300 can be rotated relative to a vertical axis. The first bar member 300 can also be horizontally and vertically moved.

As the first bar member 300 is moved vertically with respect to the longitudinal axes of the vertical members, the first bar member mounting portions 330 slide vertically along the respective mounting rail portions 240 of the vertical members 200.

As the first bar member 300 is moved horizontally in a direction parallel to the longitudinal axes of the paired base assemblies 100, the respective vertical member mounting portions 130 slide horizontally along the respective movable horizontal member rails 112.

As the first bar member 300 is moved horizontally in a direction perpendicular to the longitudinal axes of the paired base assemblies 100, the respective movable horizontal members 110 slide horizontally along the respective stationary horizontal member rails 122.

As the first bar member 300 is rotated about a vertical axis, for one or more of the paired base assemblies 100 the respective vertical member mounting portion 130 slides horizontally in a first direction along the respective movable horizontal member rails 112; and the respective movable horizontal member 110 slides horizontally in a second direction substantially perpendicular to the first direction along the respective stationary horizontal member rails 122.

When the first bar member 300 is moved rotatably about a vertical axis passing through the midpoint of its longitudinal axis:

(i) the vertical member mounting portion 130 of the first base assembly 100 slides along the respective movable horizontal member rails 112 in a first direction, and the respective vertical member mounting portion 130 of the second base assembly 100 slides along the respective movable horizontal member rails 112 in a second direction opposite to the first direction; and (ii) the respective movable horizontal member 110 of the first base assembly 100 slides along the respective stationary horizontal member rail 122 in a first direction, and the respective movable horizontal member 110 of the second base assembly 100 slides along the respective stationary horizontal member rail 122 in a second direction opposite to the first direction.

As the first bar member 300 is rotated about a vertical axis, the mounting rail engaging channel blocks 551 of the upper bar assembly 500 rotate about the respective mounting rail portions 240 of the vertical members 200.

In embodiments (as pictured in FIGS. 6 and 7) wherein the first bar member 300 comprises a hammer 350, and one or more of the first bar member mounting assemblies 330 comprise a hook member 332; switch 333 in first form 333-I; and an actuator in the form of a linear solenoid (not shown), rotation of the first bar member about its longitudinal axis in a first direction causes hammer 350 to actuate switch 333-I in a first manner by depressing switch 333-I.

Additionally, when switch 333-I is depressed by hammer 350, rotation of the first bar member about its longitudinal axis in a second direction opposed to the first direction causes hammer 350 to actuate switch 333-I in a second manner by releasing switch 333-I In use, upon actuation of the switch 333-I in the first or second manner, the actuator in the form of linear solenoid moves with respect to hook member 332 whereby the aperture engaging end 332A moves with respect to the web portion 230 of vertical member 200.

As pictured, actuation of switch 333-I in the first manner by depressing switch 333-I moves the linear solenoid with respect to hook member 332 whereby hook member 332 moves towards the web portion 230 of vertical member 200, and is capable of engaging with any one of the plurality of apertures 231.

As pictured, actuation of switch 333-I in the second manner by releasing switch 333-I moves the linear solenoid with respect to hook member 332 whereby the hook member 332 moves away from web portion 230 of vertical member 200, and can disengage with apertures of web portion 230.

However, it will be appreciated that the particular arrangement of actuation of switch 333-I by hammer 350 in relation to engagement of hook member 332 with apertures 231 can be varied as desired.

In embodiments (as pictured in FIG. 8) wherein the first bar member comprises actuating cable 370, movement of actuating cable 370 with respect to the bar member user engaging portion 310 can actuate switch 333 which is in a second form 333-II.

As pictured, in use, when cable 370 is released from bar member user engaging portion 310, switch 333-II is actuated in a first manner, and the linear solenoid moves with respect to hook member 332 such that hook member 332 moves towards the web portion 230 of vertical member 200, and is capable of engaging with any one of the plurality of apertures 231.

As pictured, in use, when cable 370 is held against bar member user engaging portion 310, switch 333-II is actuated in a second manner, and the linear solenoid moves with respect to hook member 332 such that hook member 332 moves away from web portion 230 of vertical member 200, and can disengage with an apertures 231 of web portion 230.

However, it will be appreciated that the particular arrangement of actuation of switch 333-II by cable 370 in relation to engagement of hook member 332 with apertures 231 can be varied as desired.

In some embodiments wherein main load receiving assembly vertical member engaging portion 410 of load receiving assembly 400 comprises locking mechanism 4100 (as pictured in FIG. 9), actuation of switch 333 moves the actuator of locking mechanism 4100 in the form of linear solenoid 4130.

However, it will be appreciated that in other embodiments, movement of linear solenoid 4130 of locking mechanism 4100 may be signalled in another suitable manner. For example, actuation of another switch (not shown) instead of or as well as switch 333 may be required to move linear solenoid 4130 of locking mechanism 4100.

As depicted in FIG. 9, movement of linear solenoid 4130 relative to load receiving assembly locking mechanism engagement member 4110 moves load receiving assembly locking mechanism engagement member 4110 moves relative to portion 230 of vertical member 200. It will be appreciated that locking mechanism engagement member can thereby engage or disengage with apertures 231 of web portion 230 of vertical member 200, substantially as described hereinabove in regard to hook member 332 of first bar member mounting portion 320.

In some embodiments, actuation of switch 333 in a first manner to configure hook member 332 to engage with web portion 230 also configures load receiving assembly locking mechanism engagement member 4110 to engage with web portion 230.

In some embodiments, actuation of switch 333 in a second manner to configure hook member 332 to disengage with web portion 230 also configures load receiving assembly locking mechanism engagement member 4110 to disengage with web portion 230.

However, as hereinabove described, in some embodiments movement of linear solenoid 4130 of locking mechanism 4100 is signalled in another suitable manner. It will be appreciated that, in these embodiments, signalling of the actuator in another suitable manner, e.g. by actuation of another switch (not shown) instead of or as well as switch 333, may be required to configure load receiving assembly locking mechanism engagement member 4110 to engage and/or disengage with web portion 230.

In embodiments (as pictured in FIG. 1) wherein the first bar member 300 comprises one or more hooks 360 and the vertical members 200 comprise a plurality of spaced vertical catches 220B, in use the hooks 360 of the first bar member 300 may be engaged with any one of the pairs of spaced vertical catches 220B by rotation of the first bar member 300 about its longitudinal axis.

In use, the load receiving assemblies 400 can be moved horizontally and vertically.

As the one or more load receiving assemblies is moved vertically, the respective pairs of load engaging assembly channel blocks 412 slide along the respective pairs of vertical member mounting rails 250.

As the one or more load receiving assemblies are moved horizontally in a direction parallel to the longitudinal axes of the paired base assemblies 100, the respective vertical member mounting portions 130 slide horizontally along the respective movable horizontal member rails 112.

As the one or more load receiving assemblies are moved horizontally in a direction perpendicular to the longitudinal axes of the paired base assemblies 100, the respective movable horizontal members 110 slide horizontally along the respective stationary horizontal member rails 122.

The first bar member 300 can be operatively engaged with one or more of the load receiving assemblies 400. For operative engagement, the connecting member engaging portion 334 of the first bar member mounting portion 330, and a connecting member engaging portion (not shown) of the respective load receiving assembly 400, are engaged with a connecting member (not shown) e.g. a cable or rope.

When connected, the first bar member 300 and the one or more load receiving assemblies 400 can be used in a counterbalance arrangement.

In one embodiment wherein a user engages with the user engaging portion 310 of the bar member 300, a force exerted downwardly by the one or more load receiving assemblies 400, e.g. by mounting one or more weights onto the load receiving bar member 431, reduces the force required from a user to move the first bar member 300 upwardly.

In another embodiment wherein a user engages with one or more of the load receiving assembly user engaging portions 440, a force exerted downwardly by the first bar member 300, e.g. by mounting one or more weights onto the load receiving portions 320, reduces the force required from a user to move the one or more load receiving assemblies 400 upwardly.

In another embodiment wherein a user engages with one or more of the user engaging portions 540 of the upper bar assembly 500, and the user's body weight exerts a downward force on the first bar member 300, a force exerted downwardly by the one or more load receiving assemblies 400 exerts an upward force on the on the first bar member 300, and thereby reduces the force required from a user to move the user's body upwards towards the user engaging portions 540.

In use, the position of one or both of the paired user engaging portions 540 relative to the longitudinal axes of the upper bar 510 and the lower bar 520 can be adjusted by sliding the user engaging portions along the upper bar 510.

Upon application of a downward force by a user, the paired user engaging portions 540 are stably supported by the lower bar 520.

In use, the locking assemblies (not shown) of the respective stationary horizontal members 120 of the base assemblies 100 can be engaged to constrain horizontal movement of the first bar member 300 and/or one or more of the load receiving assemblies 400 in a direction perpendicular to the longitudinal axes of the paired base assemblies 100. When said locking assemblies are engaged, the exercise apparatus may be used like a 'dual action' Smith machine.

In use, the locking assemblies 133 of the vertical member mounting assemblies 130 of the base assemblies 100 can be engaged to constrain horizontal movement of first bar member 300 and/or one or more of the load receiving assemblies 400 in a direction parallel to the longitudinal axes of the paired base assemblies 100. When said locking assemblies are engaged, the exercise apparatus may be used like a normal Smith machine.

Advantageously, the exercise apparatus 10 allows a user to rotate the first bar member about a vertical axis, in addition to allowing a user to move the first bar member horizontally and vertically. This provides a user with additional freedom of movement for exercises, e.g. bench presses, squats, and lunge exercises. The exercise apparatus 10 therefore provides freedom of movement similar to that provided by a free barbell, but also provides the additional safety of a bar member that is mounted to guides, i.e. the paired vertical members 200.

Another advantage of the exercise apparatus 10 is that it is highly adaptable and configurable, facilitating a wide range of exercises. By way of non-limiting example, the first bar member 300 can be used to perform bench presses, squats, and lunges; one or more of the load receiving assemblies can be used to perform 'press-up' or 'pull-down' exercises; and the upper bar assembly user engaging portions 540 can be used to perform 'pull-up' or 'chin-up' exercises.

Another advantage of the exercise apparatus 10 is that it facilitates partial assistance for various exercises performed by a user. As hereinbefore described, operative engagement between the first bar member 300 and the load receiving assemblies 400 can be used to offset the force required to perform various exercises facilitated by the exercise apparatus 10. This may be particularly beneficial to allow a more inexperienced user to perform exercises using the exercise apparatus 10.

Yet another advantage of the exercise apparatus 10 is that it can be locked to constrain various movements of the first bar member and/or load receiving assemblies. Where desired by a user, this allows the exercise apparatus 10 to be used as a 'dual action' Smith machine, or a normal Smith machine, as hereinbefore described.

Additionally, embodiments wherein the first bar mounting assemblies 330 comprise a locking device as pictured in FIGS. 6 and 7, and or the load receiving assemblies 400 comprise a locking device as pictured in FIG. 9 can be particularly advantageous. Notably, such locking devices can allow for first bar member 300 and/or load receiving assemblies 400 to be constrained from movement by a user during easily use, by actuation of switch 333.

This can be particularly advantageous from a safety perspective. It can also potentially obviate the need for an assistant or 'spotter' during use of exercise apparatus 1.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

The invention claimed is:

1. An exercise apparatus comprising:

one or more base assemblies, wherein the one or more base assemblies comprise: one or more vertical member mounting portions, one or more movable horizontal member portions, and one or more stationary horizontal member portions;

a pair of spaced vertical members mounted to the one or more base assemblies; and a first bar member mounted to the spaced vertical members;

wherein the one or more base assemblies facilitate multidirectional horizontal movement of the vertical members, whereby the first bar member is rotatable relative to the longitudinal axes of the vertical members, and wherein for each base assembly, the longitudinal axis of the one or more movable horizontal member portions is substantially longer than the longitudinal axes of the one or more stationary horizontal member portions;

wherein the longitudinal axis of each of the one or more movable horizontal member portions extends in a first horizontal direction, and each of the vertical member mounting portions is slidably engaged with a respective movable horizontal member portion of the one or more movable horizontal member portions and slidable in a direction substantially parallel to the longitudinal axis of the movable horizontal member portion, wherein each of the vertical member mounting portions is slidably engaged with one or more rails of the movable horizontal member portion.

2. The exercise apparatus of claim 1, wherein the apparatus further comprises one or more load receiving assemblies configured for operative association with the first bar member in a counterbalance arrangement.

3. The exercise apparatus of claim 2, wherein the one or more load receiving assemblies comprise a vertical member engaging portion; one or more load receiving portions; a connecting member engaging portion; and a user engaging portion.

4. The exercise apparatus of claim 3, wherein the one or more load receiving assemblies are slidably mounted to the vertical members and vertically slidable in relation to the longitudinal axes of the vertical members, wherein the vertical member engaging portion of each of the one or more load receiving assemblies is slidably engaged with one or more rails of the vertical members.

5. The exercise apparatus of claim 4, wherein the connecting member engaging portion of each of the one or more load engaging assemblies is configured for operative connection by a respective connecting member to the respective connecting member engaging portion of a bar mounting assembly for the first bar member.

6. The exercise apparatus of claim 5, wherein the operative connection by the respective connecting member to the respective connecting member engaging portion of the bar mounting assembly for the first bar member is via one or more pulleys.

7. The exercise apparatus of claim 1, wherein the first bar member is mounted to the paired vertical members by respective bar mounting assemblies comprising a vertical member engaging portion and a first bar member engaging portion, and further comprising a connecting member engaging portion.

8. The exercise apparatus of claim 7, wherein the respective bar mounting assemblies allow vertical and rotatable movement of the first bar member with respect to the longitudinal axis of the respective vertical member.

9. The exercise apparatus of claim 8, wherein the vertical member engaging portions are slidably and rotatably engaged with one or more rails of the respective vertical member.

10. The exercise apparatus of claim 1, wherein each of the one or more base assemblies comprises a pair of stationary horizontal member portions, and wherein the one or more movable horizontal member portions of the one or more base assemblies are slidably engaged with one or more pairs of stationary horizontal member portions of the one or more base assemblies, and slidable in a direction substantially parallel to the longitudinal axes of the pair of stationary horizontal member portions, wherein the movable horizontal member portions are engaged with one or more rails of the pair of stationary horizontal member portions.

11. The exercise apparatus of claim 10, wherein each of the opposed ends of the movable horizontal member portions is engaged with one respective stationary horizontal member portion of the one or more pairs of stationary horizontal member portions.

12. The exercise apparatus of claim 1, wherein the first bar member comprises a user engaging portion and two opposed load receiving ends.

13. The exercise apparatus of claim 12, wherein the user engaging portion of the first bar member extends between first bar member engaging portions of respective bar mounting assemblies, and the load receiving ends of the first bar member extend outwardly from the first bar member engaging portions of the respective bar mounting assemblies.

14. The exercise apparatus of claim 1, wherein the one or more base assemblies facilitate horizontal movement of the vertical members in a first horizontal plane and a second horizontal plane.

15. The exercise apparatus of claim 1, wherein the first bar member is slidably mounted to the spaced vertical members, and vertically movable relative to the longitudinal axes of the vertical members, wherein the first bar member is slidably mounted to one or more rails of each of the vertical members.

16. The exercise apparatus of claim 1, wherein each of the vertical members is rigidly mounted to a respective vertical member mounting portion of the one or more base assemblies.

17. The exercise apparatus of claim 1, wherein the vertical members are horizontally movable relative to: the one or more stationary horizontal member portions of the one or more base assemblies, and/or the one or more moveable horizontal member portions of the one or more base assemblies.

18. The exercise apparatus of claim 1, wherein a vertical member mounting portion of the one or more vertical member mounting portions for each of the vertical members is engaged with the one or more movable horizontal member portions.

19. The exercise apparatus of claim 1, wherein the one or more base assemblies is a pair of base assemblies, wherein each of the spaced vertical members is mounted to a respective base assembly.

* * * * *